US011685067B2

(12) United States Patent
Hashimoto et al.

(10) Patent No.: US 11,685,067 B2
(45) Date of Patent: Jun. 27, 2023

(54) ELECTRIC RAZOR

(71) Applicant: Panasonic Intellectual Property Management Co., Ltd., Osaka (JP)

(72) Inventors: Toshiharu Hashimoto, Osaka (JP); Shunsuke Komori, Shiga (JP); Hiroaki Shimizu, Shiga (JP); Akitaka Ito, Kyoto (JP); Daiki Matsumoto, Shiga (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 19 days.

(21) Appl. No.: 17/572,072

(22) Filed: Jan. 10, 2022

(65) Prior Publication Data

US 2022/0314471 A1 Oct. 6, 2022

(30) Foreign Application Priority Data

Mar. 30, 2021 (JP) ..... JP2021-058821

(51) Int. Cl.
*B26B 19/04* (2006.01)

(52) U.S. Cl.
CPC ..... *B26B 19/048* (2013.01)

(58) Field of Classification Search
CPC ..... B26B 19/00; B26B 19/04; B26B 19/048; B26B 19/10
USPC ..... 30/43.7–44
See application file for complete search history.

(56) References Cited

U.S. PATENT DOCUMENTS 4,240,200 A * 12/1980 Bukoschek ..... H02K 33/00 30/43.92
6,568,083 B1 * 5/2003 Taniguchi ..... B26B 19/10 30/43.2
8,671,577 B2 * 3/2014 Brown ..... B26B 21/521 30/526
10,071,490 B2 * 9/2018 Shimizu ..... B26B 19/048
10,556,354 B2 * 2/2020 Erndt ..... B26B 19/3846
11,260,548 B2 * 3/2022 Shimizu ..... B26B 19/386
(Continued)

FOREIGN PATENT DOCUMENTS

JP 2016-101366 A 6/2016

*Primary Examiner* — Jason Daniel Prone
*Assistant Examiner* — Richard D Crosby, Jr.
(74) *Attorney, Agent, or Firm* — McDermott Will & Emery LLP

(57) ABSTRACT

The present disclosure provides an electric razor that can further suppress irritation to a skin. An electric razor of the present disclosure includes a body configured to be gripped by a user, a head having three or more blade blocks, and a head support connecting the head and the body to each other. The head support supports the head in a floatable-and-sinkable way with respect to the body. The head includes a case that supports the three or more blade blocks, and a blade float that allows each of the three or more blade blocks to float and sink with respect to the case. A first urging force with which the head support urges the head in a floating direction is larger than a second urging force with which the blade float urges the plurality of blade blocks which are one or more less than three or more blade blocks in a floating direction. The first urging force is smaller than a third urging force with which the blade float urges all of the three or more blade blocks in the floating direction.

5 Claims, 3 Drawing Sheets

(56) References Cited

U.S. PATENT DOCUMENTS

| | | | | |
|---|---|---|---|---|
| 11,331,821 | B2 * | 5/2022 | Fischer | B26B 19/288 |
| 2004/0020053 | A1 * | 2/2004 | Wain | B26B 21/227<br>30/526 |
| 2004/0237310 | A1 * | 12/2004 | Shiba | B26B 19/048<br>30/531 |
| 2006/0021228 | A1 * | 2/2006 | Shiba | B26B 19/048<br>30/43.92 |
| 2007/0245576 | A1 * | 10/2007 | Peyser | B26B 21/44<br>30/529 |
| 2009/0000126 | A1 * | 1/2009 | Kraus | B26B 19/046<br>30/45 |
| 2010/0132204 | A1 * | 6/2010 | Brown | B26B 21/225<br>30/527 |
| 2010/0229397 | A1 * | 9/2010 | Nakasuka | B26B 21/227<br>30/50 |
| 2011/0094107 | A1 * | 4/2011 | Ring | B26B 19/048<br>30/42 |
| 2012/0060382 | A1 * | 3/2012 | Beugels | B26B 19/048<br>30/527 |
| 2016/0096280 | A1 * | 4/2016 | Robertson | B26B 21/24<br>30/53 |
| 2016/0151922 | A1 * | 6/2016 | Shimizu | B26B 19/146<br>30/43 |
| 2021/0268674 | A1 * | 9/2021 | Weschta | B26B 19/146 |

* cited by examiner

ELECTRIC RAZOR

RELATED APPLICATIONS

This application claims the benefit of Japanese Application No. 2021-058821, filed on Mar. 30, 2021, the disclosure of which Application is incorporated by reference herein.

BACKGROUND

1. Technical Field

The present disclosure relates to an electric razor.

2. Description of the Related Art

Conventionally, an electric razor includes a body configured to be gripped by a user, a head having a function of shaving hair, and a head support connecting the body and the head (refer to PTL 1, for example). The head support supports the head so as to float and sink with respect to the body. On the other hand, the head has a plurality of blade blocks for shaving hair, and each of the blade blocks is supported by a blade float so as to float and sink with respect to the head. Here, an urging force applied such that the head support floats with respect to the head is set to be larger than an urging force applied such that the blade float floats with respect to one blade block. As a result, when only one blade block touches a skin, the head does not sink, and thus operation can be performed without discomfort.

Further, the urging force applied such that the head support floats with respect to the head is set to be smaller than a total of the urging forces applied such that the blade float floats with respect to each blade block. As a result, when all the blade blocks touch the skin and a sudden force is applied, the head sinks instantly, which suppresses a strong touch of some blade blocks on the skin to suppress irritation to the skin.

CITATION LIST

Patent Literature

PTL 1: Unexamined Japanese Patent Publication No. 2016-101366

SUMMARY

When all the blade blocks are continuously pressed against the skin, the force is distributed to each blade block although the head sinks, and thus none of the blade blocks sinks with respect to the head and may continuously maintain an initial height. Thus, some blade blocks may continuously touch the skin strongly to increase irritation to the skin.

Therefore, an object of the present disclosure is to provide an electric razor that can further suppress irritation to a skin.

In order to achieve the above object, an electric razor according to one aspect of the present disclosure includes a body configured to be gripped by a user, a head having three or more blade blocks each comprising an outer blade and an inner blade which is disposed inside the outer blade and sliding with respect to the outer blade, and a head support connecting the head and the body to each other, in which the head support supports the head in a floatable-and-sinkable way with respect to the body, the head comprises a case that supports the three or more blade blocks, and a blade float that allows each of the three or more blade blocks to float and sink with respect to the case, and the head support urges the head in a floating direction with a first urging force, the first urging force being larger than a second urging force with which the blade float urges a plurality of blade blocks that are one or more less than the three or more blade blocks in a floating direction, the plurality of blade blocks being included in the three or more blade blocks, the first urging force being smaller than a third urging force with which the blade float urges all of the three or more blade blocks in the floating direction.

The electric razor of the present disclosure can further suppress irritation to the skin.

DETAILED DESCRIPTION

Hereinafter, an exemplary embodiment of an electric razor of the present disclosure will be described with reference to the drawings. Note that the following exemplary embodiment is intended to give an example for describing the present disclosure, and is not intended to limit the present disclosure. For example, a shape, structure, material, component, relative positional relationship, connection state, numerical value, mathematical formula, content of each stage in a method, order of each stage, and the like illustrated in the following exemplary embodiment are examples. What is not listed below may be included in the present disclosure. Geometrical expressions such as parallel and orthogonal may be used, but these expressions do not indicate mathematical rigor and include substantially permissible errors and deviations. Expressions such as simultaneous and identical also include a substantially permissible range. The drawings are schematic views in which emphasis, omission, and ratio adjustment are appropriately performed in order to describe the present disclosure, and may be different from actual shapes, positional relationships, and ratios.

Further, in the following, a plurality of disclosures may be comprehensively described as one exemplary embodiment. Some of the contents described below are described as arbitrary components relating to the present disclosure.

(Configuration of Electric Razor)

Figure 1:
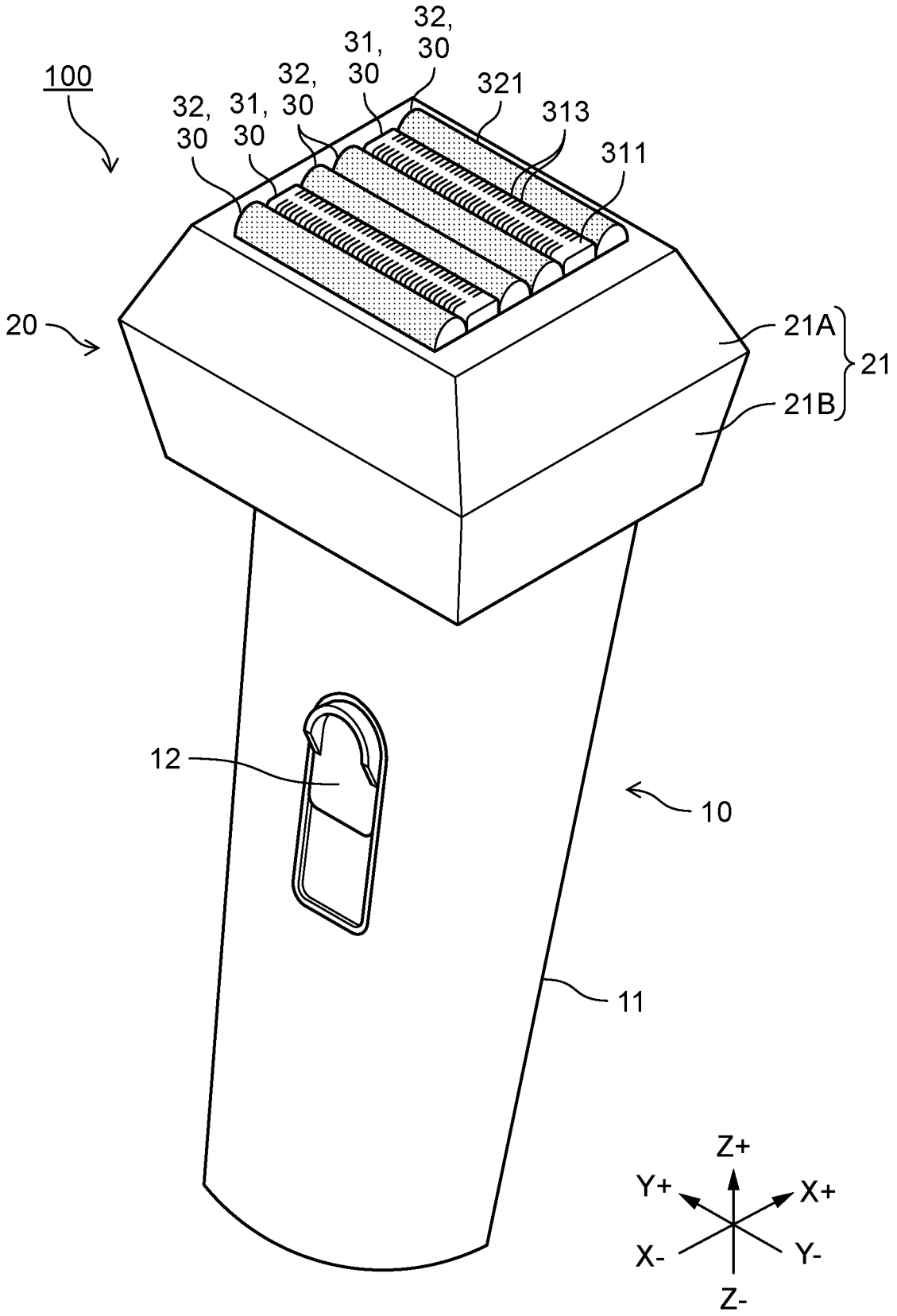
FIG. 1 is a perspective view illustrating a schematic configuration of an electric razor according to an exemplary embodiment.

FIG. 1 is a perspective view of an electric razor. Electric razor 100 has parts in which an edge has been chamfered and which have irregularities for preventing slipping, but these parts are not shown in the drawing.

As shown in FIG. 1, electric razor 100 includes body 10 having a plurality of elements constituting electric razor 100, head 20 having a hair shaving function, and a head support 50 (see FIG. 2) connecting body 10 and head 20. Body 10 includes grip 11 configured to be gripped by a user, power switch 12 for switching power supply of body 10 on and off, and a power supply unit (not shown) for supplying power to a drive source (not shown) built in head 20.

Figure 2:
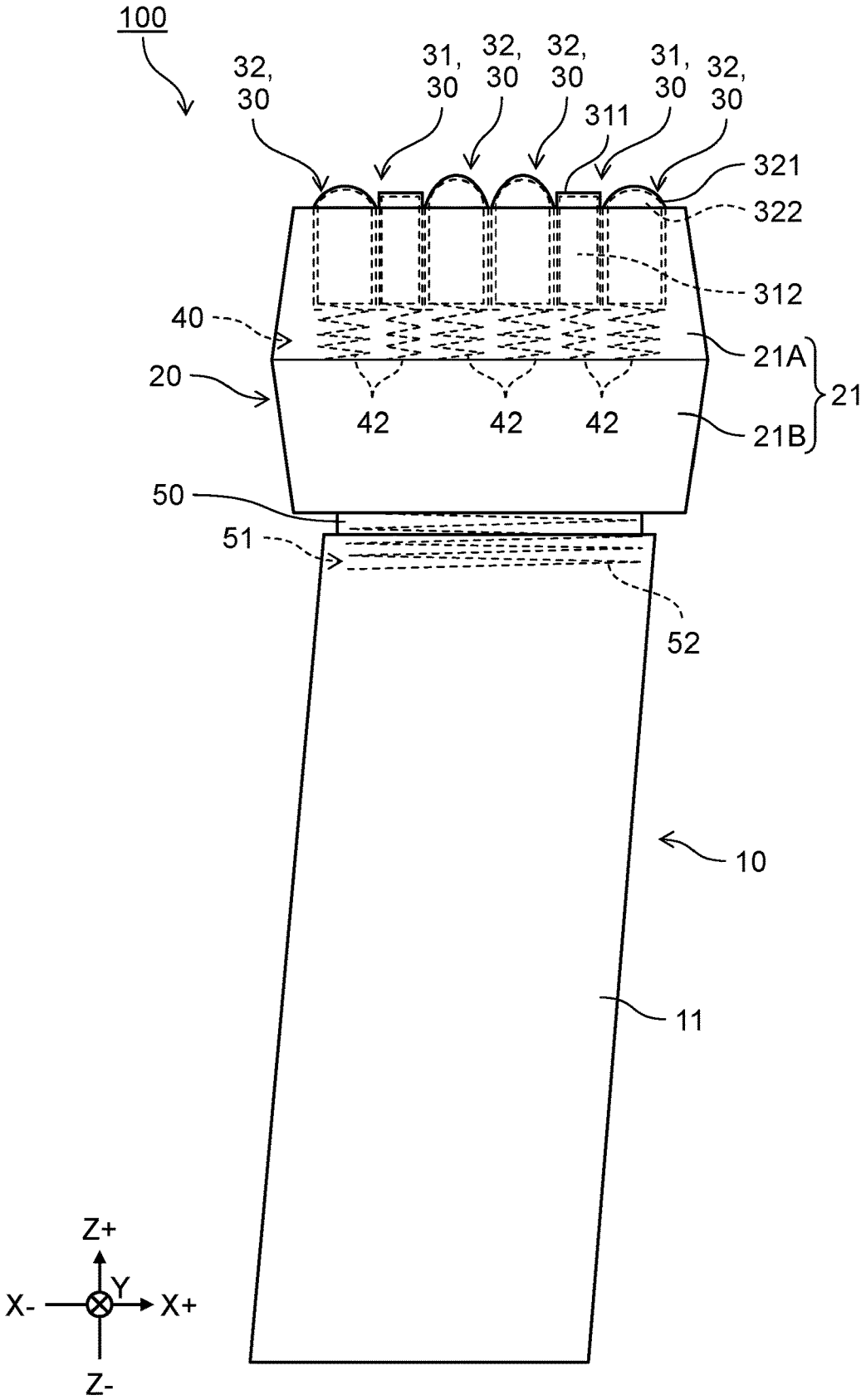
FIG. 2 is a schematic view illustrating each float of a head and a head support according to the exemplary embodiment.

FIG. 2 is a schematic view illustrating each float of head 20 and head support 50 according to the exemplary embodiment. As shown in FIG. 2, head support 50 has head float 51 that supports head 20 in a floatable-and-sinkable way with respect to body 10. In other words, head support 50 has head float 51 that supports head 20 configured to float and sink with respect to body 10. Head float 51 has elastic body 52 such as a spring or rubber that applies an urging force to head 20 in a direction in which head 20 floats (that is, separates) from body 10. Head float 51 maintains head 20 floating furthest from body 10 when head 20 is not subjected to an external force. When head 20 receives an external force, elastic body 52 contracts in head float 51, and thus head 20 sinks toward body 10.

Head 20 includes case 21 that constitutes appearance, a plurality of blade blocks 30, blade float 40, and a drive source. The drive source is a linear motor, for example, and is connected to each blade block 30 via a transmission mechanism (not shown). As a result, power from the drive source is transmitted to each blade block 30 via the transmission mechanism, and each blade block 30 operates.

Case 21 is a part that accommodates blade float 40 and the drive source and supports the plurality of blade blocks 30. Case 21 includes upper case 21A in which blade float 40 and the plurality of blade blocks 30 are disposed and lower case 21B that accommodates the drive source. An upper end of each blade block 30 protrudes from an upper surface of upper case 21A. Case 21 is formed by connecting upper case 21A and lower case 21B to each other.

The plurality of blade blocks 30 are arranged such that extending directions thereof are parallel to a Y-axis direction. The plurality of blade blocks 30 includes slit blade block 31 and mesh blade block 32. In the present exemplary embodiment, the plurality of blade blocks 30 includes two slit blade blocks 31 and four mesh blade blocks 32. Two slit blade blocks 31 are disposed at predetermined intervals in an X-axis direction. In each slit blade block 31, one mesh blade block 32 is disposed on each side in the X-axis direction. In other words, the plurality of blade blocks 30 are arranged in an order of mesh blade block 32, slit blade block 31, mesh blade block 32, mesh blade block 32, slit blade block 31, and mesh blade block 32 in the X-axis direction.

Slit blade block 31 is a part for cutting long hair that is difficult to shave with mesh blade block 32. Slit blade block 31 has slit blade 311 as an outer blade and inner blade 312. Slit blade 311 is a member that is elongated in the Y-axis direction and has an inverted U-shape as viewed in the Y-axis direction. As shown in FIG. 1, a plurality of slits 313 extending in the X-axis direction have been formed at both ends in the X-axis direction on an upper surface of slit blade 311. The plurality of slits 313 are arranged in the Y-axis direction, and a part between slits 313 functions as a blade. Since slit blade 311 has a larger upper opening in a height direction than mesh blade 321, which will be described later, it is possible to introduce and cut hair longer than hair introduced by mesh blade block 32.

As shown in FIG. 2, inner blade 312 is a member that is disposed inside slit blade 311, slides with respect to an inner surface of slit blade 311, and cuts hair having entered slits 313 with the part between slits 313. A shape and an operation mode of inner blade 312 are determined in relation to slit blade 311 and are not limited. In the present exemplary embodiment, the shape of inner blade 312 is formed by arranging a plurality of blades matching a shape of the inner surface of slit blade 311 in an extending direction of slit blade 311 (the Y-axis direction in the drawing). The power of the drive source is configured to be transmitted to inner blade 312 via the transmission mechanism. Inner blade 312 is reciprocated in the extending direction of slit blade 311 (Y-axis direction in the drawing) by the power transmitted from the drive source via the transmission mechanism. As a result, the hair that has entered slits 313 is sandwiched and cut between the part between slits 313 and the blade of inner blade 312.

Mesh blade block 32 is a part for cutting hair shorter than slit blade 311. Mesh blade block 32 has mesh blade 321 as an outer blade and inner blade 322. Mesh blade 321 is a member that is elongated in the Y-axis direction and has an inverted U-shape as viewed in the Y-axis direction, and has an upper surface that is curved to protrude in a cross section in the Y-axis direction. Mesh blade 321 is a member having a thickness thinner than a wall thickness of the upper surface of slit blade 311. Mesh blade 321 is a net blade made by bending a thin plate having multiple holes, and has a function of deep shaving to shave short hair from a root.

Inner blade 322 is disposed inside mesh blade 321 and slides with respect to an inner surface of mesh blade 321, cuts hair having entered each hole of mesh blade 321 with each hole. A shape and an operation mode of inner blade 322 are determined in relation to mesh blade 321 and are not limited. In the present exemplary embodiment, the shape of inner blade 322 is formed by arranging a plurality of blades matching a shape of the inner surface of mesh blade 321 in an extending direction of mesh blade 321 (the Y-axis direction in the drawing). The power of the drive source is configured to be transmitted to inner blade 322 via the transmission mechanism. Inner blade 322 is reciprocated in the extending direction of mesh blade 321 (Y-axis direction in the drawing) by the power transmitted from the drive source via the transmission mechanism. As a result, the hair that has entered each hole of mesh blade 321 is sandwiched and cut between each hole and the blade of inner blade 312.

Blade float 40 is a part that allows each blade block 30 to float and sink with respect to case 21. Blade float 40 has a plurality of elastic bodies 42 such as a spring or rubber that individually apply an urging force to each blade block 30 in a direction in which each blade block 30 floats (that is, separates) from case 21. Specifically, each elastic body 42, which is provided for each blade block 30, can urge each blade block 30 individually. Each elastic body 42 only has to be configured to urge each blade block 30 without restricting operation of inner blades 312 and 322 of each blade block 30. Blade float 40 maintains each blade block 30 floating furthest from case 21 when each blade block 30 is not subjected to an external force. When each blade block 30 receives an external force in a direction of sinking in (that is, approaching) case 21, each elastic body 42 contracts in blade float 40, and thus each blade block 30 sinks toward case 21.

Here, an initial position of each blade block 30 will be described. The initial position is a position of each blade block 30 when each blade block 30 is not subjected to an external force, that is, when each blade block 30 is not in contact with a skin. FIG. 2 illustrates a state in which each blade block 30 is in the initial position.

As shown in FIG. 2, among the plurality of blade blocks 30, the initial positions of two mesh blade blocks 32 located at innermost positions are set to an identical position, and tips (that is, upper ends) are located at positions protruding from case 21 as compared with the other blade blocks 30.

Among the plurality of blade blocks 30, the initial positions of two mesh blade blocks 32 located at outermost positions are set to an identical position, and tips (that is, upper ends) are located at positions protruding from case 21 as compared with each slit blade block 31. That is, the initial position of each slit blade block 31 is a position that does not protrude from case 21 as compared with the other blade blocks 30, and is set to the identical position.

In a state where each blade block 30 sinks furthest, a lowest point of each blade block 30 is set such that the tip (that is, the upper end) of each blade block 30 is at the identical position.

(Urging Force of Floats)

Next, a relationship of the urging forces applied by floats (that is, head float 51 and blade float 40) will be described. Hereinafter, the urging force applied to head 20 by head float 51 is referred to as a first urging force. The urging force applied to four mesh blade blocks 32 by blade float 40 is referred to as a mesh urging force. The mesh urging force is an example of a second urging force. The second urging force is a force with which blade float 40 urges the plurality of blade blocks 30 which are one or more less than three or more blade blocks 30 in a floating direction. Thus, in the present exemplary embodiment, the urging force applied four blade blocks 30 (that is, mesh blade blocks 32), which are one or more less than six blade blocks 30, is an example of the second urging force. In other words, the second urging force (for example, the mesh urging force) is a total of the urging forces applied to each mesh blade block 32. In the present exemplary embodiment, the urging forces applied to each mesh blade block 32 are equal. Therefore, a total of the urging forces applied to two innermost mesh blade blocks 32 and a total of the urging forces applied to two outermost mesh blade blocks 32 are also the same as each other. The urging forces applied to each mesh blade block 32 may be different from each other.

The urging force applied by blade float 40 to two slit blade blocks 31 is referred to as a slit urging force. In the present exemplary embodiment, a case is illustrated where the mesh urging force (that is, one type of the second urging force) is set smaller than the slit urging force, but may be equal to or larger than the slit urging force.

Here, assuming that a sum of the mesh urging force and the slit urging force is a third urging force, the first urging force is set to be larger than the second urging force and smaller than the third urging force. In order to satisfy this relationship, spring constants of elastic body 52 of head float 51 and each elastic body 42 of blade float 40 are set.

Figure 3:
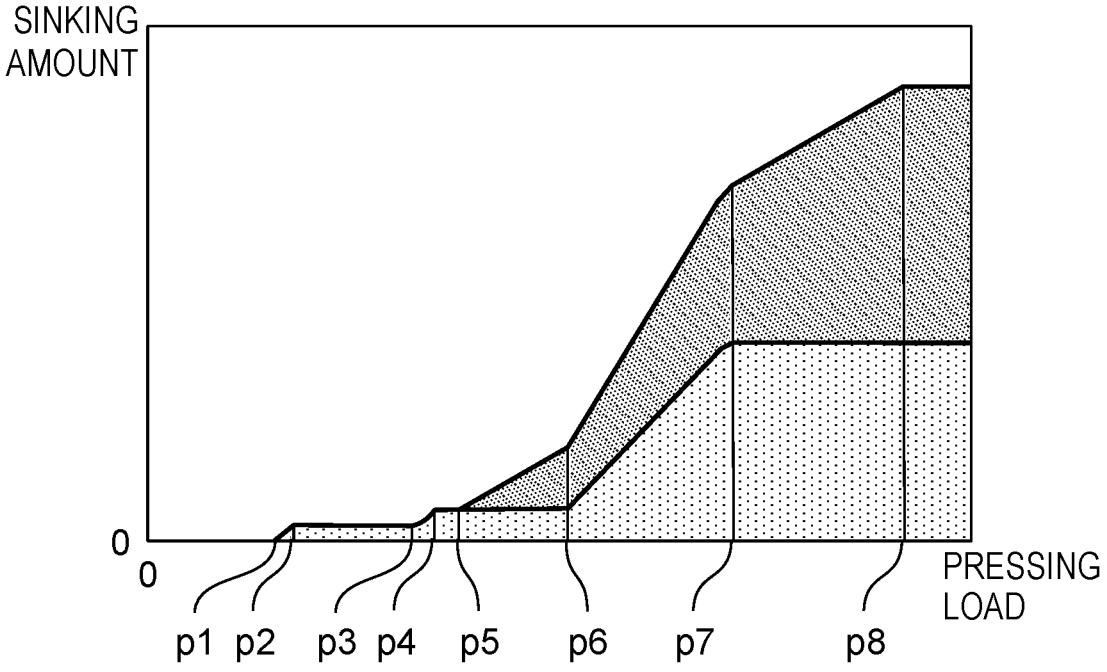
FIG. 3 is a graph illustrating a relationship between a pressing load applied to the head as a whole according to the exemplary embodiment and a sinking amount of each blade block and the head.

FIG. 3 is a graph showing a relationship between a pressing load applied to head 20 as a whole according to the exemplary embodiment and a sinking amount of each blade block 30 and head 20. In FIG. 3, a thin dot hatched part indicates the sinking amount of each blade block 30, and a dark dot hatched part indicates the sinking amount of head 20.

First, two innermost mesh blade blocks 32, the initial positions of which protrude most, are in contact with the skin, and the pressing load increases in this state. As shown in FIG. 3, when the pressing load reaches point p1 and becomes larger than the total of the urging forces applied to two innermost mesh blade blocks 32, two mesh blade blocks 32 start to sink.

Then, when the pressing load reaches point p2, the skin comes into contact with two outermost mesh blade blocks 32, the initial positions of which protrude as compared with slit blade block 31. From this time until the pressing load exceeds the mesh urging force (that is, between points p2 and p3), two outermost mesh blade blocks 32 do not operate, and thus the sinking amount becomes constant.

Then, when the pressing load reaches point p3 and becomes larger than the mesh urging force, two outermost mesh blade blocks 32 start to sink.

Then, when the pressing load reaches point p4, the skin comes into contact with two slit blade blocks 31. From this time until the pressing load exceeds the third urging force (that is, between points p4 and p6), two slit blade blocks 31 do not operate, and thus the sinking amount of each blade block 30 becomes constant.

Here, point p5 is a point where the pressing load is equal to the first urging force. When the pressing load exceeds point p5, head 20 starts to sink. That is, head 20 starts to sink with all blade blocks 30 in contact with the skin.

Then, when the pressing load reaches point p6 and becomes larger than the third urging force, two slit blade blocks 31 start to sink. From this time until each blade block 30 reaches the lowest point (that is, points p6 to p7), each blade block 30 sinks evenly. Similarly, head 20 also gradually increases the sinking amount.

Then, when the pressing load reaches point p7 and each blade block 30 sinks to the lowest point, the sinking amount of each blade block 30 becomes constant after that, but the sinking amount of head 20 increases. Finally, when the pressing load reaches point p8 and head 20 sinks to the lowest point, the sinking amount of head 20 also becomes constant.

Effects

As described above, electric razor 100 according to the present exemplary embodiment includes body 10 configured to be gripped by the user, head 20 having three or more blade blocks 30 including outer blades (that is, slit blade 311 and mesh blade 321), inner blades 312 and 322 that are disposed inside the outer blades and slide with respect to the outer blades, and head support 50 that connects head 20 and body 10 to each other. Head support 50 supports head 20 in a floatable-and-sinkable way with respect to body 10. Head 20 includes case 21 that supports three or more blade blocks 30, and blade float 40 that allows each of three or more blade blocks 30 to float and sink with respect to case 21. The first urging force with which head support 50 urges head 20 in the floating direction is larger than the second urging force with which blade float 40 urges the plurality of blade blocks 30 which are one or more less than three or more blade blocks 30 in the floating direction, and smaller than the third urging force with which blade float 40 urges all of three or more blade blocks 30 in the floating direction.

Accordingly, the first urging force is larger than the second urging force and smaller than the third urging force, and thus the plurality of blade blocks 30 (in the present exemplary embodiment, four mesh blade block 32) sink before head 20 starts to sink. That is, after the plurality of blade blocks 30 come into contact with the skin and sink from the initial positions, head 20 starts to sink. As a result, it is possible to prevent one blade block 30 from continuously touching the skin strongly before head 20 sinks. It is therefore possible to further suppress irritation to the skin.

Further, when an excessive force (for example, a force larger than the third urging force) suddenly acts on blade block 30, head 20 starts to sink together with blade block 30. In this case, the irritation to the skin can be still further suppressed.

Further, head 20 has five or more blade blocks 30. Blade float 40 allows each of five or more blade blocks 30 to float and sink with respect to case 21. The second urging force is an urging force with which blade float 40 urges four blade blocks 30 among five or more blade blocks in the floating direction. The third urging force is an urging force with which blade float 40 urges all five or more blade blocks 30 in the floating direction.

Accordingly, the second urging force is an urging force that urges four blade blocks 30 in the floating direction, and the third urging force is an urging force that urges all of five or more blade blocks 30 in the floating direction. Therefore, head 20 beings to sink between the time when four blade blocks 30 start to sink and the time when all blade blocks 30 start to sink. That is, before head 20 starts to sink, four blade blocks 30 have sunk from the initial positions in a state of being in contact with the skin. Thus, a contact area with the skin can be increased and the irritation to the skin can be further suppressed.

Further, three or more blade blocks 30 include mesh blade block 32 having mesh blade 321 as an outer blade and slit blade block 31 having slit blade 311 provided with the plurality of slits 313 as outer blades. A target of the second urging force applied by blade float 40 is mesh blade block 32.

Mesh blade block 32, which is a part more suitable for deep shaving than slit blade block 31, is desirably in contact with the skin more reliably than slit blade block 31. In other words, in a case where the second urging force is applied to mesh blade block 32 to be in contact with the skin rather than slit blade block 31, it is possible to make head 20 start to sink reliably after mesh blade block 32 comes into contact with the skin and starts to sink.

Further, the initial position of mesh blade block 32 protrudes from case 21 as compared with the initial position of slit blade block 31.

Accordingly, the initial position of mesh blade block 32 protrudes from case 21 as compared with the initial position of slit blade block 31, and thus mesh blade block 32 can be reliably brought into contact with slit blade block 31 before slit blade block 31. Therefore, mesh blade block 32 can be easily brought into contact with a complex part such as under a nose.

Further, the urging force to mesh blade block 32 is smaller than the urging force to slit blade block 31.

Accordingly, the urging force to mesh blade block 32 is smaller than the urging force to slit blade block 31, and thus mesh blade block 32 is more likely to sink than slit blade block 31. That is, an impact absorbing power of mesh blade block 32 that comes into contact with the skin first can be increased, and the irritation to the skin can be further suppressed.

Others

Although the electric razor according to the present disclosure has been described above on the basis of the above exemplary embodiment, the present disclosure is not limited to the above exemplary embodiment.

For example, in the above exemplary embodiment, electric razor 100 provided with six blade blocks 30 is illustrated. However, a total number of the blade blocks only has to be more than or equal to three. For example, when there are three blade blocks, it is sufficient that the second urging force is an urging force to the two blade blocks, the third urging force is an urging force to all of the three blade blocks, and the first urging force is larger than the second urging force and smaller than the third urging force. When there are five blade blocks, it is sufficient that the second urging force is an urging force to the four blade blocks, the third urging force is an urging force to all of the five blade blocks, and the first urging force is larger than the second urging force and smaller than the third urging force.

In the above exemplary embodiment, a case is illustrated where the target to which the second urging force is applied is only mesh blade block 32. However, the target to which the second urging force is applied may be only the slit blade block, or both the mesh blade block and the slit blade block.

Further, in the above exemplary embodiment, as a number of blade blocks 30, four mesh blade blocks 32 and two slit blade blocks 31 are exemplified. However, the number of mesh blade blocks and slit blade blocks may be any number more than or equal to one.

In the above exemplary embodiment, as the arrangement of each blade block 30, two mesh blade blocks 32 are disposed at the outermost positions, two mesh blade blocks 32 are disposed at the innermost positions, and each one of two slit blade blocks 31 is disposed between two mesh blade blocks 32 at the outermost positions and between two mesh blade blocks 32 at the inner most positions. However, both or one of the outermost blade blocks may be slit blade blocks, or three or more blade blocks of the same type may be arranged in succession.

Further, in the above exemplary embodiment, a case is illustrated where the initial positions of mesh blade blocks 32 protrude from case 21 as compared with the initial position of slit blade block 31. However, the initial position of the slit blade block may protrude from case 21 as compared with the initial positions of the mesh blade blocks.

Furthermore, the present disclosure includes a mode obtained by applying various modifications conceived by those skilled in the art to the exemplary embodiment, and a mode realized by arbitrarily combining components and functions in the exemplary embodiment without departing from the gist of the present disclosure.

The present disclosure is applicable to an electric razor capable of shaving body hair of animals including humans, such as a so-called electric shaver for shaving a beard.

What is claimed is:

1. An electric razor comprising:

a body configured to be gripped by a user;

a head having three or more blade blocks each comprising an outer blade and an inner blade which is disposed inside the outer blade and sliding with respect to the outer blade; and a head support connecting the head and the body to each other, wherein the head support supports the head in a floatable-and-sinkable way with respect to the body, the head comprises:

a case that supports the three or more blade blocks; and a blade float that allows each of the three or more blade blocks to float and sink with respect to the case, and the head support urges the head in a floating direction with a first urging force, the first urging force being larger than a second urging force with which the blade float urges a plurality of blade blocks that are one or more less than the three or more blade blocks in a floating direction, the plurality of blade blocks being included in the three or more blade blocks, the first urging force being smaller than a third urging force with which the blade float urges all of the three or more blade blocks in the floating direction.

2. The electric razor according to claim 1, wherein the three or more blade blocks comprises five or more blade blocks in the head, the blade float allows each of the five or more blade blocks to float and sink with respect to the case, the second urging force is an urging force with which the blade float urges four blade blocks of the five or more blade blocks in the floating direction, and the third urging force is an urging force with which the blade float urges all of the five or more blade blocks in the floating direction.

3. The electric razor according to claim 1, wherein the three or more blade blocks comprises a mesh blade block having a mesh blade as the outer blade and a slit blade block having a slit blade as the outer blade provided with a plurality of slits, and a target to which the second urging force is applied by the blade float is the mesh blade block.

4. The electric razor according to claim 3, wherein the mesh blade block has an initial position that protrudes from the case as compared with an initial position of the slit blade block.

5. The electric razor according to claim 4, wherein an urging force to the mesh blade block is smaller than an urging force to the slit blade block.

* * * * *